US006672742B2

(12) United States Patent
Alley

(10) Patent No.: US 6,672,742 B2
(45) Date of Patent: Jan. 6, 2004

(54) CANDLE SHADE

(76) Inventor: Milton Alley, R.R. #3, Firelane 10, Niagara-on-the-Lake, Ontario, L0S 1J0 (CA)

( * ) Notice: Subject to any disclaimer, the term of this patent is extended or adjusted under 35 U.S.C. 154(b) by 0 days.

(21) Appl. No.: 09/989,987

(22) Filed: Nov. 21, 2001

(65) Prior Publication Data

US 2002/0105810 A1 Aug. 8, 2002

Related U.S. Application Data

(60) Provisional application No. 60/252,485, filed on Nov. 22, 2000.

(51) Int. Cl.[7] ..... F21V 11/00

(52) U.S. Cl. ..... 362/351; 362/173; 362/171; 362/161; 362/163; 362/176; 362/315

(58) Field of Search ..... 362/161, 163, 362/173, 186, 180, 171, 176, 312, 314, 315, 351; 431/293

(56) References Cited

U.S. PATENT DOCUMENTS 1,890,378 A * 12/1932 Godoy ..... 362/161
2,717,306 A * 9/1955 Meara ..... 362/163
3,867,625 A * 2/1975 Whalen ..... 362/161
4,755,135 A 7/1988 Kwok
6,328,935 B1 * 12/2001 Buccellato ..... 422/125
6,457,969 B1 * 10/2002 Khosla ..... 431/291

FOREIGN PATENT DOCUMENTS

DE 296 21 262 3/1997
FR 2 715 995 8/1995

* cited by examiner

*Primary Examiner*—Stephen Husar
*Assistant Examiner*—Bertrand Zeade
(74) *Attorney, Agent, or Firm*—Connolly Bove Lodge & Hutz LLP

(57) ABSTRACT

A candle shade includes a sleeve adapted to receive a top end of a candle and a shade element coupled to the sleeve and surrounding the candle adjacent the top end. The sleeve has at least one spacing element on its interior surface to space the sleeve from the candle and reduce contact area therebetween. A stop is also provided on the sleeve to inhibit the sleeve from travelling down the candle beyond the top end.

32 Claims, 7 Drawing Sheets

CANDLE SHADE

CROSS-RELATED APPLICATION

The present application claims the benefit of U.S. Provisional Patent Application Ser. No. 60/252,485, filed on Nov. 22, 2000 for an invention entitled "Candle Shade".

FIELD OF THE INVENTION

The present invention relates generally to shades and in particular to a candle shade to shade the wick of a candle.

BACKGROUND OF THE INVENTION

Candleholders or shades to shade the wick of a candle are known and are commonly used as decorative accents. One known candleholder includes a shade, a drip cup and frame assembly, a sleeve and a base. The base includes a socket to accommodate the bottom end of a candle. The sleeve is adapted to be placed on the top end of the candle. The drip cup and frame assembly is placed on the sleeve and supports the shade. When the wick of the candle is lit and the candle begins to melt, the shade and the drip cup and frame assembly descend with the sleeve. Unfortunately, problems exist with this candleholder design. In particular, in use, the sleeve tends to stick to the candle body, resulting in melting of the candle without the sleeve and drip cup and frame assembly descending with the candle as it melts. If this occurs, the weight of the shade and the drip cup and frame assembly can cause the candle to topple, bend or break as the candle melts. As will be appreciated, this may pose a potential fire hazard if the candle has been left unattended.

To overcome the disadvantages associated with the above-identified candleholder, alternative candleholders have been considered. For example, German Patent Document No. 296 21 262 to Shieh discloses a candleholder including a base with a centrally disposed sleeve to receive the bottom end of a candle. An upright, inverted U-shaped bracket is mounted on the base. A sleeve is adapted to be placed on the top end of the candle. A drip cup and shade holder assembly is placed on the sleeve and accommodates the bracket. A glass sleeve surrounds the drip cup and shade holder assembly. A shade rests on the drip cup and shade holder assembly and is spaced from the glass sleeve. When the wick of the candle is lit and the candle melts, the sleeve descends with the candle as the candle melts. The shade and the drip cup and shade holder assembly in turn descend with the sleeve. The bracket guides the movement of the shade and the drip cup and shade holder assembly to inhibit toppling of the candle under the weight of the shade and the drip cup and shade holder assembly.

U.S. Pat. No. 4,755,135 to Kwok discloses a candle device including a thermally insulated candleholder having a spring therein. A cover overlies the open top of the candleholder and has an aperture therein. A candle is placed within the candleholder on top of the spring. The spring urges the candle upwardly against the cover so that the wick of the candle passes through the aperture. Thermally conductive wires extend from the aperture to the perimeter of the candle, to ensure uniform melting of the candle when the wick of the candle is lit. The candleholder can be adapted to include a shade.

Although candleholders that include shades to shade the wick of a candle are known, improved aesthetically pleasing candle shades are desired. It is therefore an object of the present invention to provide a novel candle shade.

SUMMARY OF THE INVENTION

Accordingly, in one aspect of the present invention there is provided a candle shade comprising:

a sleeve adapted to receive a top end of a candle, said sleeve having an interior surface, at least one spacing element on said interior surface to space said interior surface from the candle and a stop on said sleeve to inhibit said sleeve from travelling down the candle beyond the top end thereof; and a shade element coupled to said sleeve and surrounding said candle adjacent said top end.

Preferably, the candle shade includes at least one vent to permit air flow into the shade element adjacent the top end of the candle. In a preferred embodiment, the stop is an inwardly directed annular flange adjacent a top end of the sleeve. The flange rests on the top of the candle and defines an aperture through which the wick of the candle passes. It is also preferred that the flange has a depression surrounding the wick formed in its upper surface.

In one embodiment, the at least one spacing element is in the form of a plurality of ribs formed on the interior surface. The ribs may be vertical and spaced about the circumference of the sleeve. Alternatively, the ribs may be circular and disposed at vertically spaced locations on the interior surface or may be helical and extend between opposite ends of the sleeve. In another embodiment, the at least one spacing elements are spaced projections formed on the interior surface.

In one embodiment, the sleeve and the shade element are integrally formed. In this case, the shade element includes a bowl with the sleeve depending from the bowl. In another embodiment, the shade element and the sleeve are separate parts. In this case, the shade element includes a bowl with a depending second sleeve that accommodates the first sleeve. The depending second sleeve rests on a support surface formed on the outer surface of the first sleeve.

According to yet another aspect of the present invention there is provided a candle shade comprising:

a sleeve adapted to receive a top end of a candle, said sleeve having an inwardly directed stop thereon to rest on the top of said candle and spacing elements on an interior surface thereof, said spacing elements contacting said candle to reduce contact area between said sleeve and said candle; and a shade element coupled said sleeve and surrounding said candle above said top end.

The present invention provides advantages in that the candle shade is easy and inexpensive to manufacture while remaining aesthetically pleasing. The candle shade is also designed to descend smoothly with the candle as the candle melts thereby avoiding situations where the candle melts faster than the candle shade descends.

BRIEF DESCRIPTION OF THE DRAWINGS

Preferred embodiments of the present invention will now be described more fully with reference to the accompanying drawings wherein like reference numerals denote like parts throughout the several views, and in which.

DETAILED DESCRIPTION OF THE PREFERRED EMBODIMENTS

Figure 1:
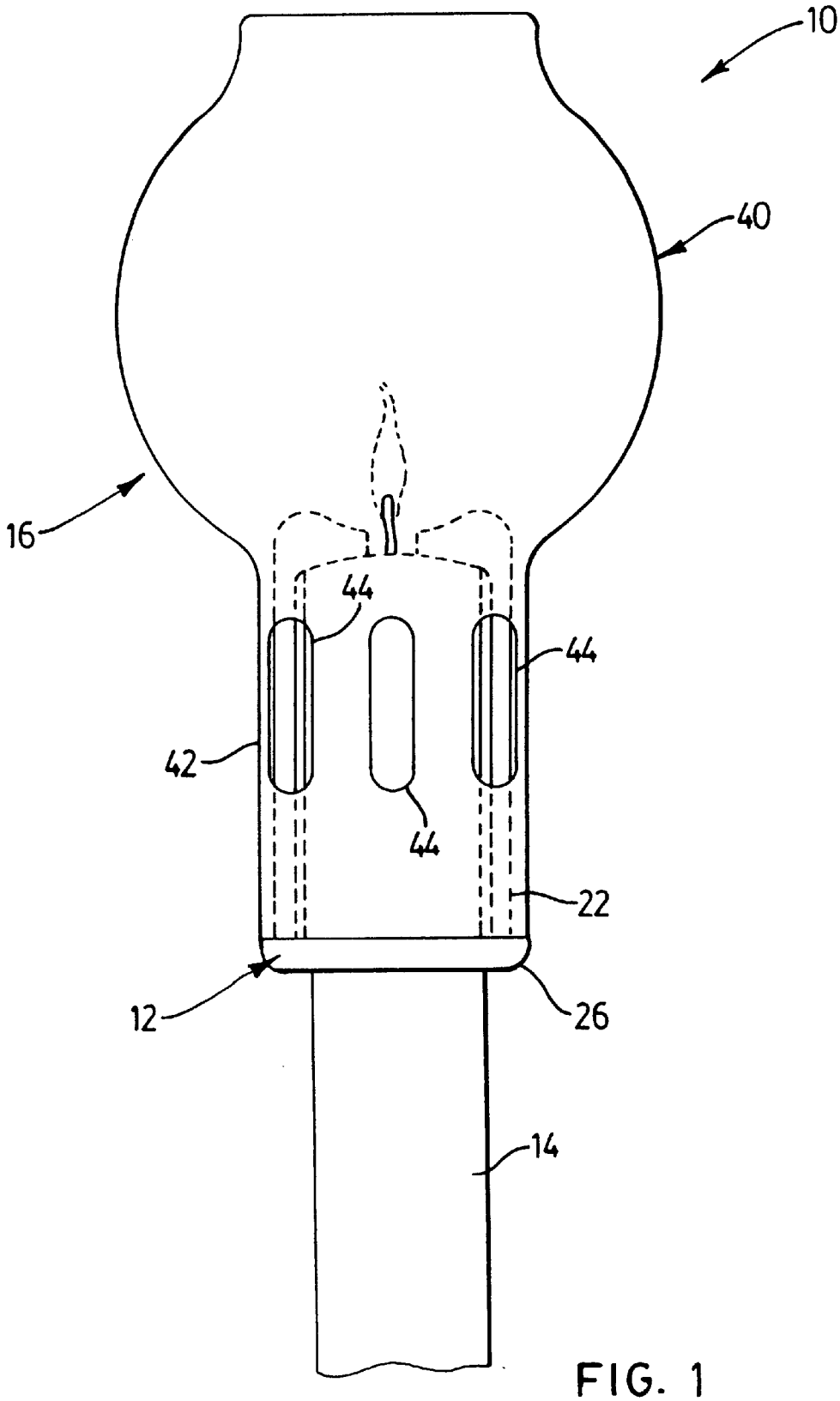
FIG. 1 is a side elevational view of a candle shade in accordance with the present invention.
Figure 2:
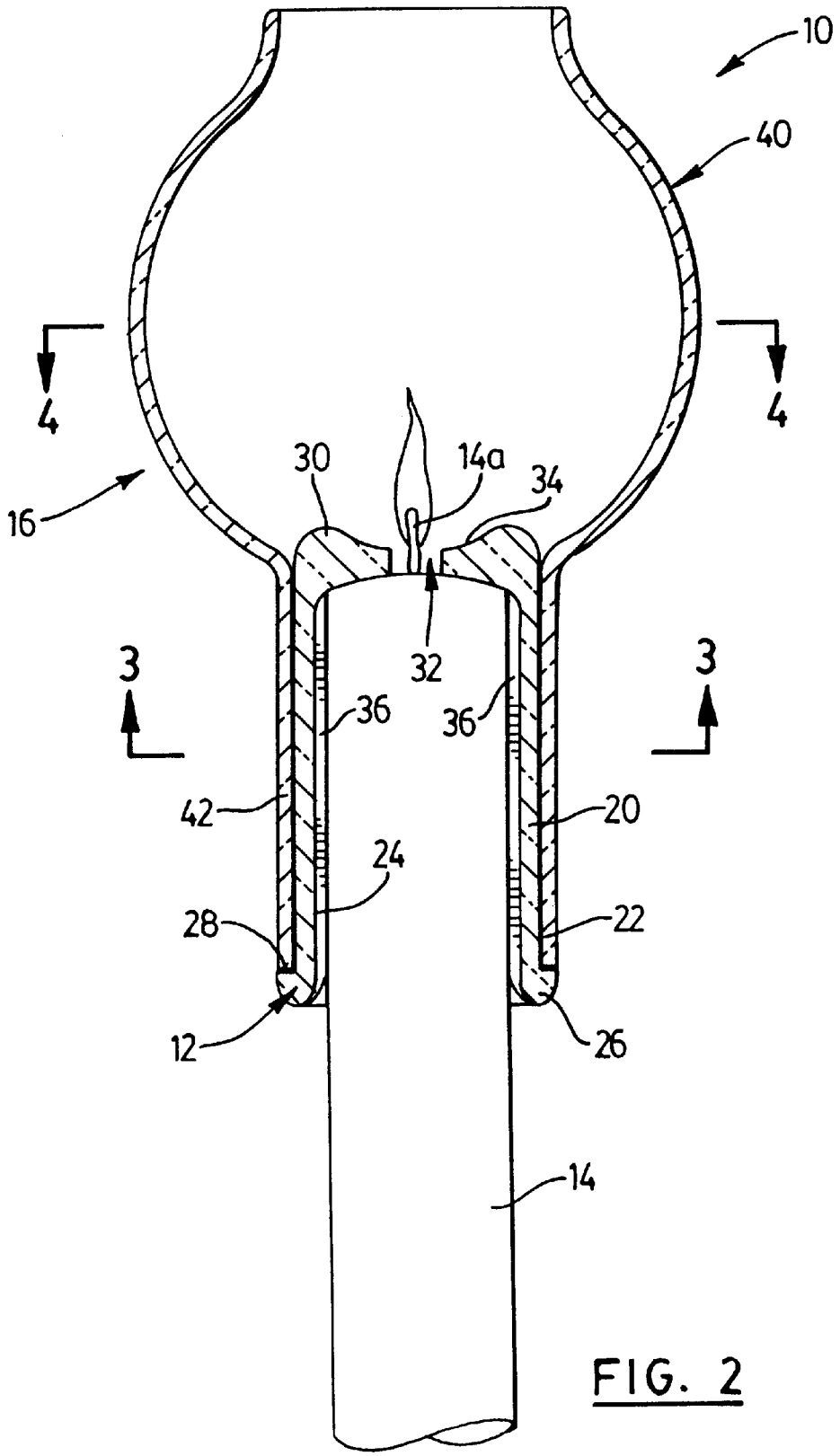
FIG. 2 is a cross-sectional view, in side elevation, of the candle shade of FIG. 1.
Figure 3:
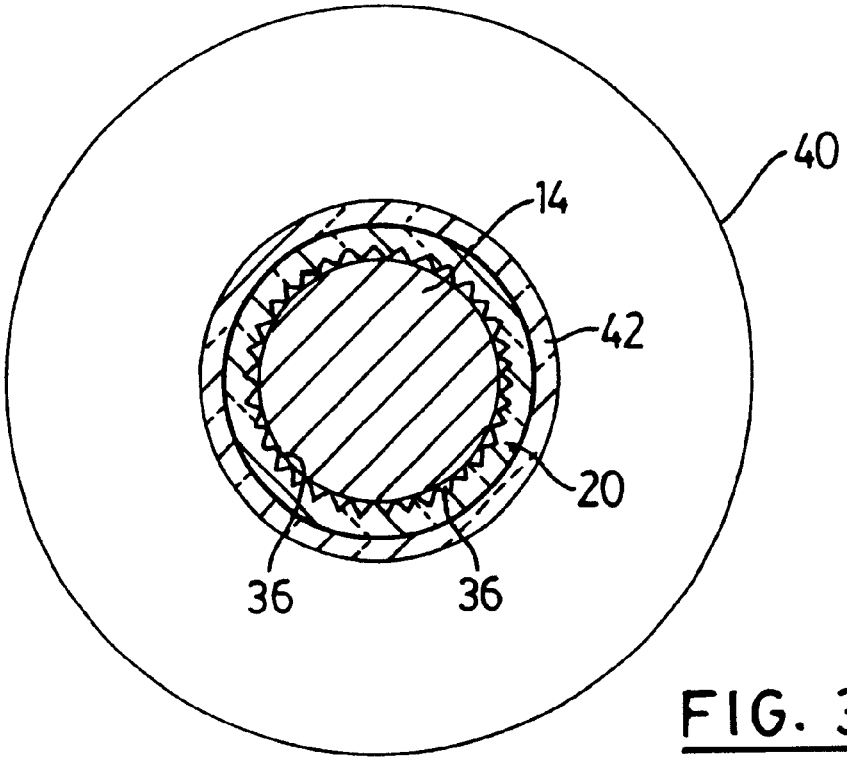
FIG. 3 is a cross-section of FIG. 2 taken along line 3—3.
Figure 4:
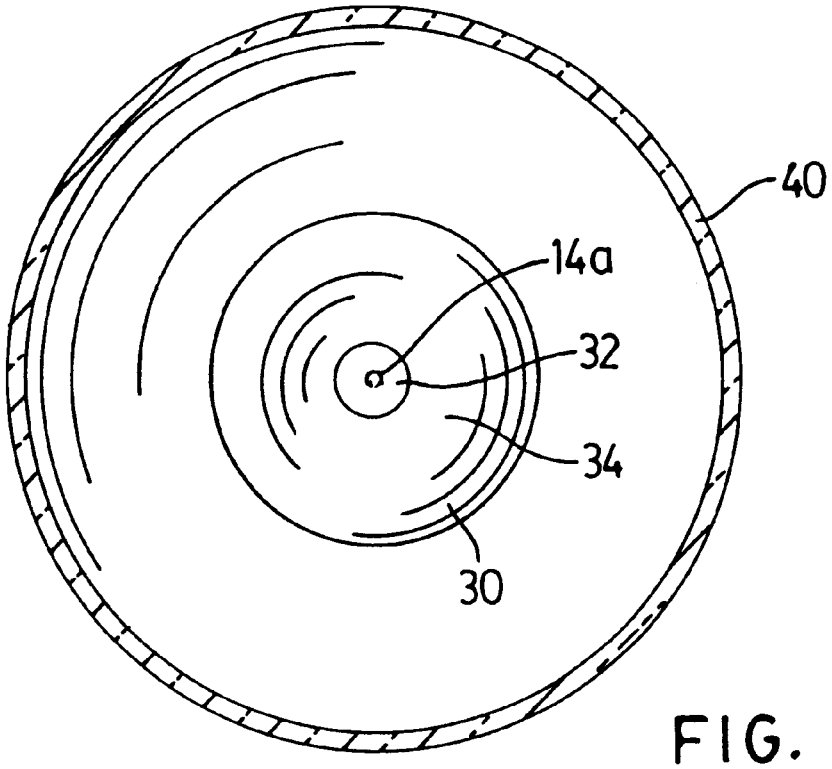
FIG. 4 is a cross-section of FIG. 2 taken along line 4—4.

Turning now to FIGS. 1 to 4, a candle shade in accordance with the present invention is shown and is generally identified by reference numeral 10. In the present embodiment, candle shade 10 is formed of glass although other suitable transparent, translucent and/or opaque materials may be used. As can be seen, candle shade 10 includes a tubular sleeve 12 adapted to be placed on and receive the top end of a candle 14. A shade element 16 sits on the sleeve 12 and surrounds the wick 14*a* of the candle 14.

Sleeve 12 includes a cylindrical side wall 20 having an outer surface 22 and an interior surface 24. An outwardly extending flange 26 is formed adjacent the bottom end of the sleeve 12 and defines an annular support surface 28 on which the shade element 16 sits. An inwardly extending flange 30 is formed at the top end of the sleeve 12 and defines a central aperture 32 through which the wick 14*a* of the candle 14 passes. A depression 34 surrounding the wick 14*a* is formed in the top of the flange 30. Vertical ribs 36 are formed on the interior surface 24 of the sleeve 12. The ribs 36 are equally spaced about the circumference of the sleeve 12 and act to space the interior surface 24 of the sleeve from the body of the candle 14. Thus, the ribs 36 reduce the contact area between the sleeve 12 and the candle 14.

Shade element 16 in the present embodiment includes a bowl 40 that terminates in a depending sleeve 42. Sleeve 42 is sized so that its diameter is greater than the diameter of the sleeve 12 allowing sleeve 42 to slide freely over sleeve 12. The diameter of the sleeve 42 is however smaller than the outer diameter of the flange 26. Thus, sleeve 42 accommodates the sleeve 12 and rests on the annular support surface 28 thereby to position the bowl 40 above the candle 14.

Vents 44 are provided in the sleeve 42 at circumferentially spaced locations to permit air to be drawn into the bottom portion of the bowl 40 via the space between the sleeves 42 and 12 when the wick 14*a* of the candle 14 is lit. The bowl 40 is shaped so that air drawn into the bowl 40 travels from the bottom to the top of the bowl in a smooth flow. The smooth air flow ensures sufficient air for the purpose of combustion and serves to cool the bowl 40 and sleeves 42 and 12.

In use, the sleeve 12 is placed on the top end of the candle 14 so that the flange 30 rests on the top of the candle and the wick 14*a* of the candle is lit. Thus, the flange 30 acts as a stop to ensure the sleeve 12 remains at the top of the candle 14. The sleeve 42 is then placed over the sleeve 12 so that it rests on the annular support surface 28. In this manner, the bowl 40 surrounds the top of the candle 14 to shade the burning wick 14*a*. As the candle 14 melts, the sleeve 12 and the shade element 16 descend with the melting candle under the weight of the shade element 16. Melting wax from the candle 14 is collected in the depression 34 to inhibit the flow of wax into the channels defined between adjacent ribs 36. Since the ribs 36 space the interior surface 24 of the sleeve 12 from the body of the candle 14, the contact area between the sleeve 12 and the candle 14 is reduced. As a result, the coefficient of friction between the sleeve 12 and the candle body is reduced facilitating smooth and supported movement of the sleeve 12 and the shade element 16 downwardly with the candle 14 as the candle melts. As mentioned previously, the vents 44 and the shape of bowl 40 permit sufficient air flow into the bowl 40 to ensure good combustion and cooling.

Although the ribs 36 formed on the interior surface of the sleeve 12 are shown as being vertically oriented, alternative rib configurations are possible. For example, the ribs may be circular and positioned on the interior surface of the sleeve at vertically spaced locations. This rib design is better suited for use with drip-less candles. Alternatively, the ribs may be helical. In this case, the shape of the ribs causes the sleeve 12 and shade element 16 to rotate as the candle melts and the sleeve and shade element descend with the melting candle.

If desired vents may also be provided in the sleeve 12 and/or the bowl 40. If vents are provided in the sleeve 12, it is preferred that the vents are positioned so that the vents in the sleeves 42 and 12 align when the sleeve 42 accommodates the sleeve 12.

Figure 5:
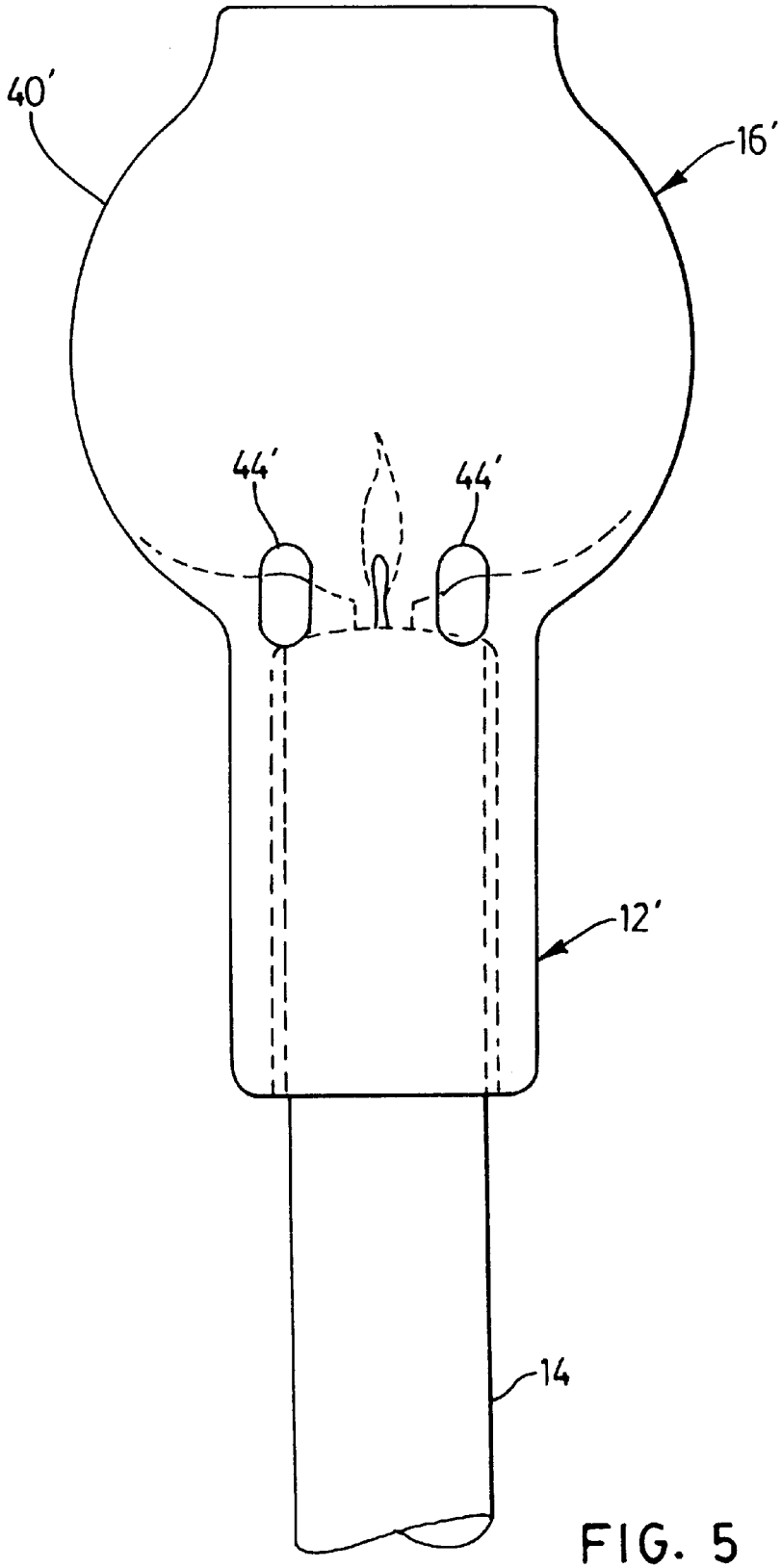
FIG. 5 is a side elevational view of another embodiment of a candle shade in accordance with the present invention.
Figure 6:
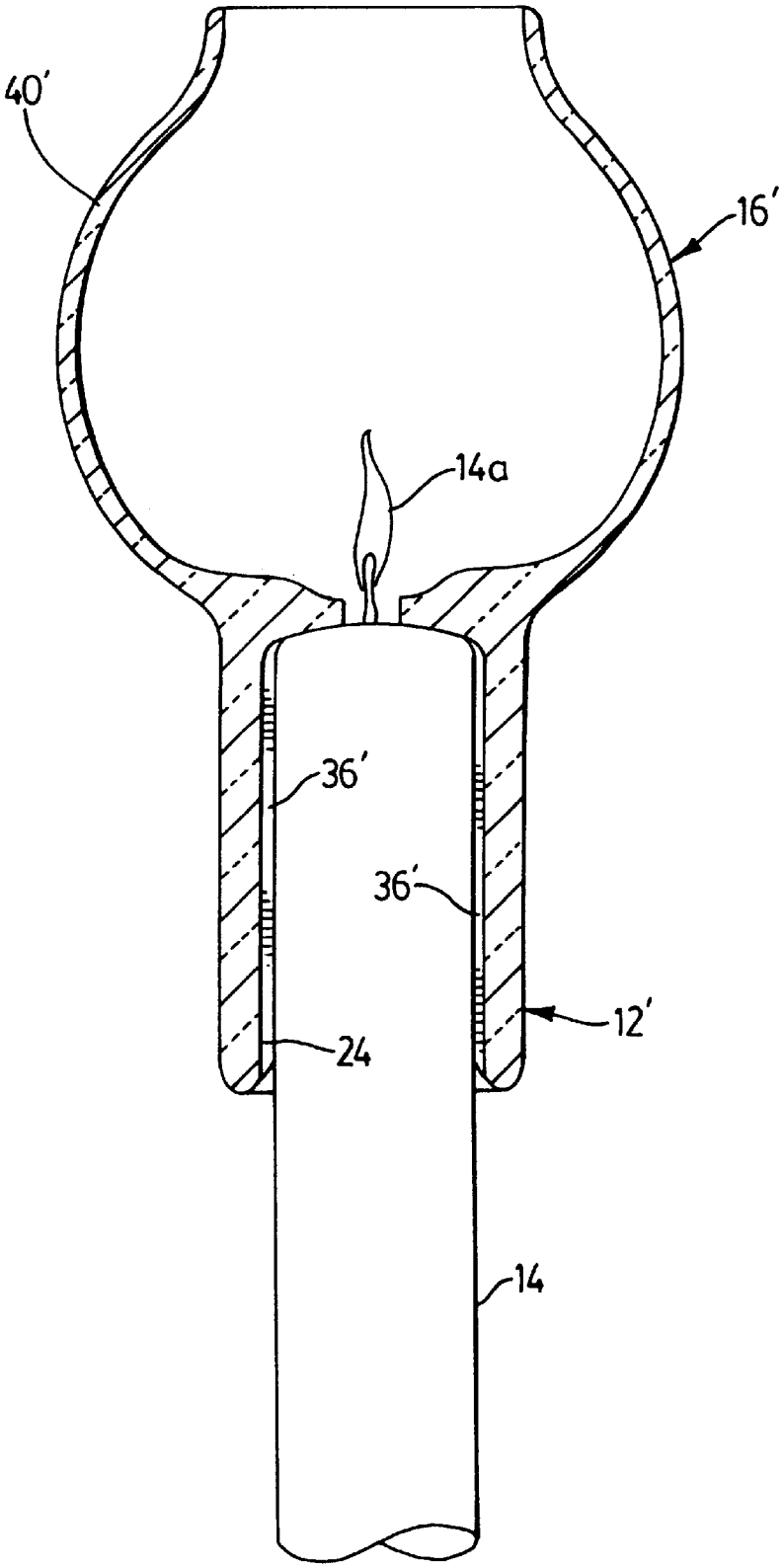
FIG. 6 is cross-sectional view, in side elevation, of the candle shade of FIG. 5.

Also, although the candle shade 10 is described as including a sleeve 12 that is separate from the shade element 16, the sleeve 12 and shade element 16 can be integrally formed as shown in FIGS. 5 and 6. As can be seen, in this embodiment the sleeve 12' is integral with and depends from the bowl 40'. Ribs 36' are formed on the interior surface 24' of the sleeve 12' to space the interior surface of the sleeve 12' from the candle body. Vents 44' are formed in the bowl 40' at circumferentially spaced locations adjacent the flange 30' to permit air flow into the bowl when the wick 14*a* of the candle 14 is lit.

Figure 7:
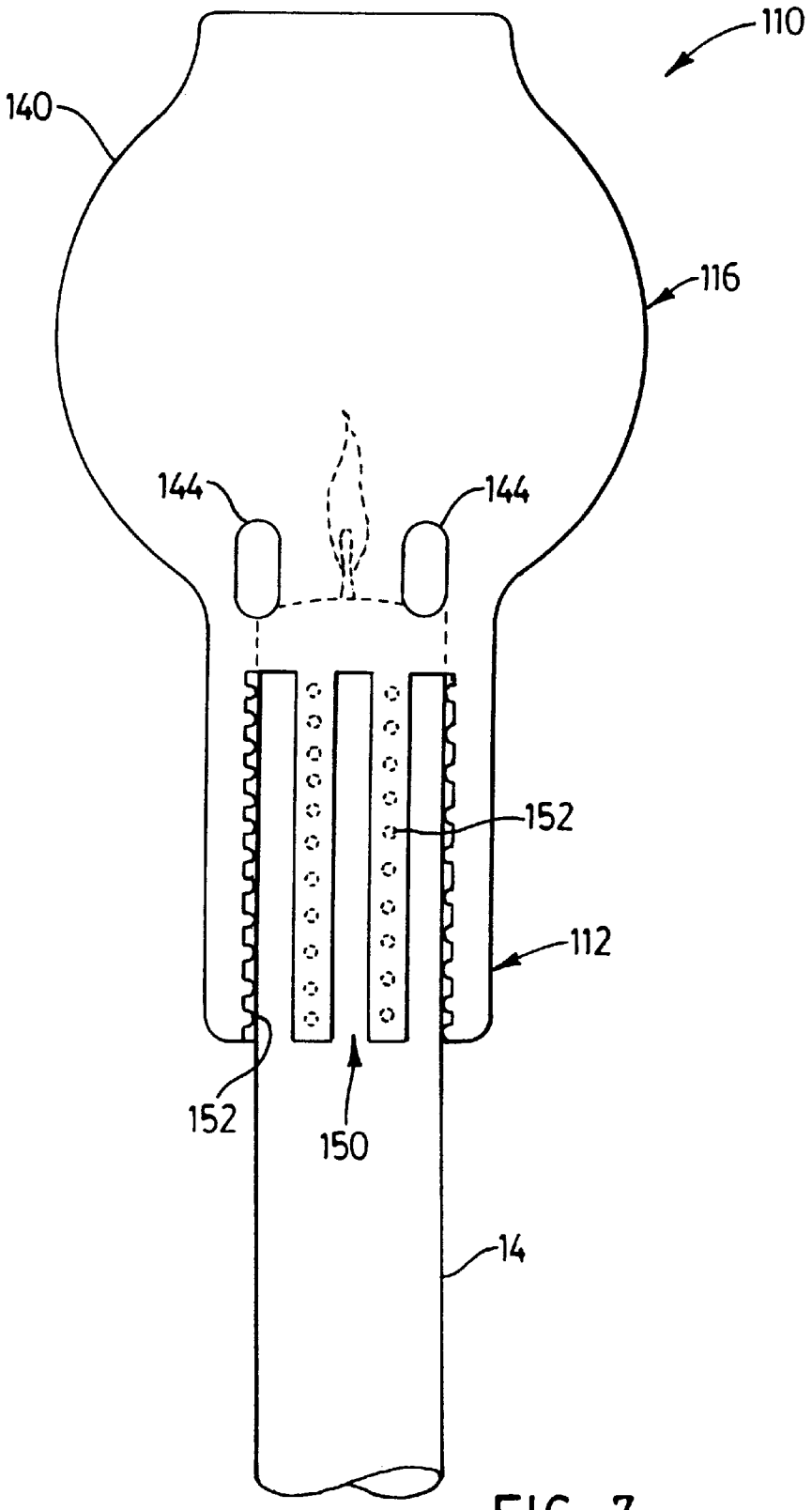
FIG. 7 is a side elevational view of yet another embodiment of a candle shade in accordance with the present invention.

Turning now to FIG. 7, yet another embodiment of a candle shade 110 in accordance with the present invention is shown. Similar to the previous embodiment, the shade element 116 and sleeve 112 are integrally formed. Vents 144 are formed in the bowl 140 at circumferentially spaced locations. In this embodiment, the sleeve 112 has vertical slots 150 provided therein. Also, rather than using ribs to space the interior surface of the sleeve from the candle body, projections 152 are formed on the interior surface of the sleeve 112 at spaced locations.

As will be appreciated by those skilled in the art, the spacing elements to reduce the contact area between the interior of the sleeve and the candle body may take a variety of shapes provided the spacing elements permit the sleeve to descend with the candle as the candle melts.

Figure 8:
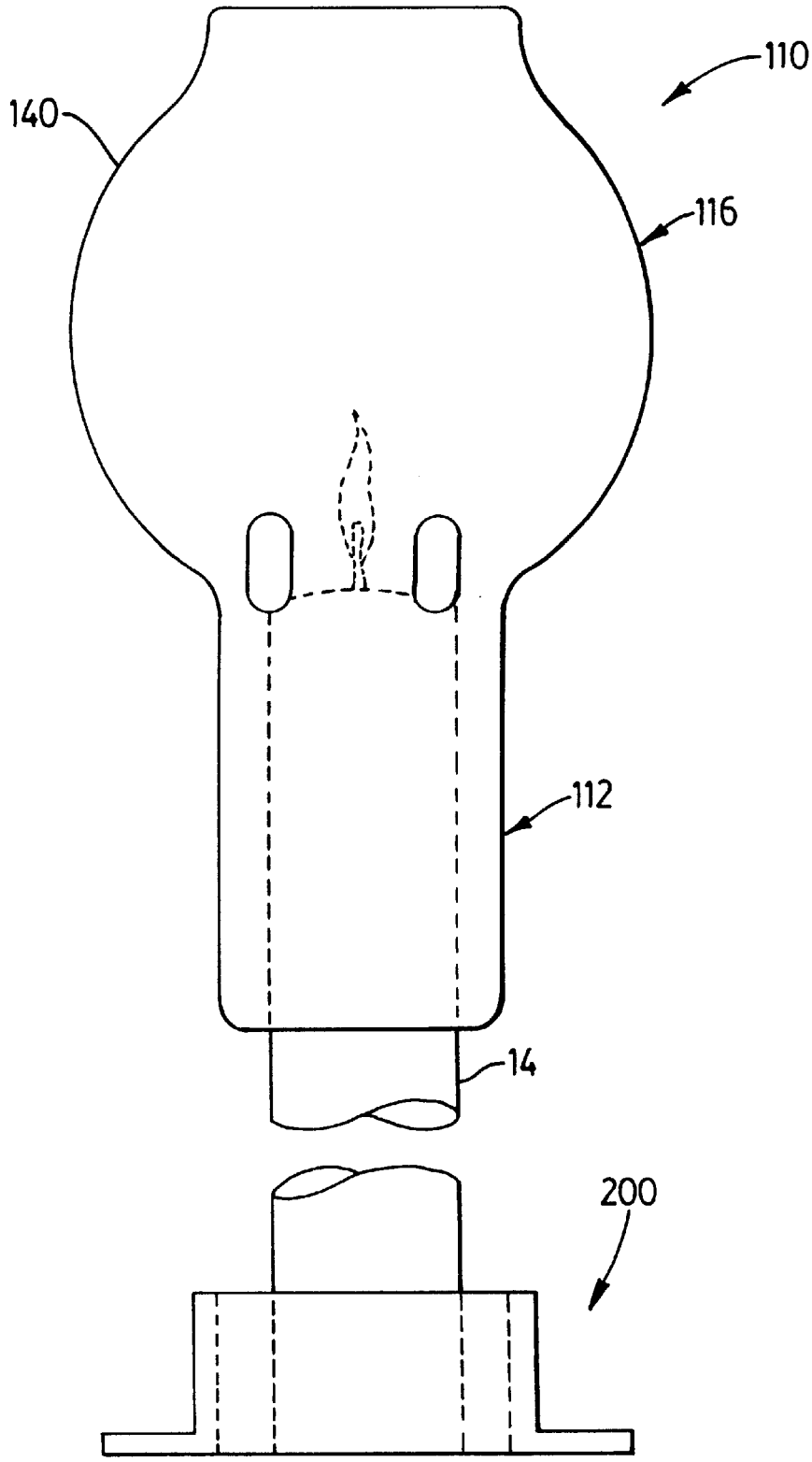
FIG. 8 is a side elevational view of the candle shade of FIG. 5 in combination with a candle shade support.

The candle shade may also be used in combination with a candle shade support 200 as illustrated in FIG. 8. As can be seen, the candle shade support 200 is designed to support the candle 14 and receive the bottom of the sleeve 112 when the sleeve descends with the melting candle. In this manner, the candle shade 110 is supported by the candle shade support 200 in an upright manner after the candle has burned down.

As will be appreciated, the present candle shade is designed to descend with the candle as the candle melts in a smooth and controlled manner while ensuring adequate air flow for combustion and cooling. The candle shade is aesthetically pleasing and may carry decorative accents.

Although preferred embodiments of the present invention have been described, those of skill in the art will however appreciate that variations and modifications may be made without departing from the spirit and scope thereof as defined by the appended claims.

What is claimed is:

1. A candle shade comprising:

an elongate first sleeve adapted to receive a top end of a candle, said sleeve having an interior surface, at least one spacing element on said interior surface to space said interior surface from the candle and a stop on said sleeve adjacent a top end thereof to inhibit said sleeve from travelling down the candle beyond the top end of said candle; and a shade element coupled to said sleeve to surround the top end of said candle.

2. A candle shade according to claim 1 further including at least one vent to permit air flow into said shade element adjacent said top end.

3. A candle shade according to claim 2 wherein said stop is an inwardly directed flange adjacent the top end of said sleeve, said flange being adapted to rest on the top of said candle and defining an opening through which the wick of said candle passes.

4. A candle shade according to claim 3 wherein said flange is annular and defines a circular aperture through which said wick passes.

5. A candle shade according to claim 4 wherein said flange has a depression formed in an upper surface thereof, said depression surrounding said aperture.

6. A candle shade according to claim 2 wherein said at least one spacing element is in the form of a plurality of spaced ribs formed on said interior surface.

7. A candle shade according to claim 6 wherein said ribs are vertical and are spaced about the circumference of said sleeve.

8. A candle shade according to claim 6 wherein said ribs are circular and are disposed at vertically spaced locations along said sleeve.

9. A candle shade according to claim 6 wherein said ribs are helical and extend between opposite ends of said sleeve.

10. A candle shade according to claim 2 wherein said sleeve and said shade element are integrally formed.

11. A candle shade according to claim 10 wherein said shade element includes a bowl and wherein said sleeve depends from said bowl.

12. A candle shade according to claim 11 wherein said at least one vent is formed in said bowl adjacent said stop.

13. A candle shade according to claim 12 wherein vents are provided in said bowl at circumferentially spaced locations.

14. A candle shade according to claim 2 wherein said shade element includes a bowl and a second sleeve depending from said bowl, said second sleeve accommodating said first sleeve, and resting on a support surface formed on an outer surface of said first sleeve.

15. A candle shade according to claim 14 wherein said first sleeve has an outwardly extending annular flange thereon adjacent a bottom end thereof, said outwardly extending flange defining said support surface.

16. A candle shade according to claim 14 wherein said at least one vent is formed in at least one of said bowl and second sleeve.

17. A candle shade according to claim 16 wherein said at least one vent is formed in said bowl adjacent said stop.

18. A candle shade according to claim 17 wherein vents are provided in said bowl at circumferentially spaced locations.

19. A candle shade according to claim 16 wherein said at least one vent is formed in said second sleeve.

20. A candle shade according to claim 19 wherein vents are provided in said second sleeve at circumferentially spaced locations.

21. A candle shade according to claim 2 wherein said shade element is shaped to provide smooth air flow therethrough during combustion when the wick of said candle is lit.

22. A candle shade comprising:

a first elongate sleeve adapted to receive a top end of a candle, said sleeve having an inwardly directed stop thereon adjacent a top end thereof to rest on the top of said candle and a plurality of spaced spacing elements on an interior surface of said sleeve, said spacing elements contacting said candle to reduce contact area between said sleeve and said candle; and a shade element coupled said sleeve to surround said candle above said top end.

23. A candle shade according to claim 22 wherein said stop is an inwardly directed flange having a depression formed in an upper surface thereof and defining an aperture through which the wick of said candle passes, said depression surrounding said aperture.

24. A candle shade according to claim 22 wherein said spacing elements are vertical ribs disposed about the circumference of said sleeve at spaced locations.

25. A candle shade according to claim 22 wherein said spacing elements are circular ribs disposed at vertically spaced locations along said sleeve.

26. A candle shade according to claim 22 wherein said spacing elements are helical ribs extending between opposite ends of said sleeve.

27. A candle shade according to claim 22 wherein said spacing elements are spaced projections formed on said interior surface.

28. A candle shade according to claim 22 further comprising at least one vent provided in at least one of said sleeve and shade element.

29. A candle shade according to claim 28 wherein vents are provided in said shade element at circumferentially spaced locations.

30. A candle shade according to claim 28 wherein said sleeve and said shade element are integrally formed.

31. A candle shade according to claim 30 wherein said shade element includes a bowl and wherein said sleeve depends from said bowl.

32. A candle shade according to claim 28 wherein said shade element includes a bowl and a second sleeve depending from said bowl, said second sleeve accommodating said first sleeve, and resting on a support surface formed on an outer surface of said first sleeve.

* * * * *